United States Patent [19]

Glen

[11] Patent Number: 4,808,131

[45] Date of Patent: Feb. 28, 1989

[54] STEERING AND CONTROL GEAR

[75] Inventor: Robert D. Glen, Oxfordshire, Great Britain

[73] Assignee: E.P. Barrus Limited, Bicester, Great Britain

[21] Appl. No.: 78,734

[22] Filed: Jul. 28, 1987

[30] Foreign Application Priority Data

Jul. 28, 1986 [GB] United Kingdom ..... 8618363

[51] Int. Cl.[4] ..... B63H 5/12

[52] U.S. Cl. ..... 440/63; 114/144 R; 74/480 B

[58] Field of Search ..... 440/53, 61, 62, 63, 440/84, 87, 900; 114/144 R, 160; 74/480 R, 480 B, 481, 482, 484 R, 491, 492, 494

[56] References Cited

U.S. PATENT DOCUMENTS 2,744,418 5/1956 Weber ..... 74/480 B 2,968,192 1/1961 Fletcher ..... 74/480 B

FOREIGN PATENT DOCUMENTS 2031362 4/1980 United Kingdom ..... 440/63

*Primary Examiner*—Joseph F. Peters, Jr.

*Assistant Examiner*—Jesus D. Sotelo

*Attorney, Agent, or Firm*—Saidman, Sterne, Kessler & Goldstein

[57] ABSTRACT

A first tie rod 7 pivots at each end at 8 to respective steering brackets 3 for two outboard motors 1 and 2. Thus, whichever tiller 6 is moved (of either motor) the other will follow by interconnection. A second tie rod pivots at each end 11 to the upper ends respectively of two arms 12 attached one to each throttle grip 5. If either throttle grip 5 is twisted the other also moves by virtue of the tie rod interconnection 10 and arms 12.

4 Claims, 1 Drawing Sheet

STEERING AND CONTROL GEAR

This invention relates to the steering and control gear for use with outboard engines.

It is commonplace to use two or more outboard engines at the stern of a vessel. Our earlier Great Britain Patent No. 2 031 362B describes the way in which such engines can be used together so that they can be both controlled (as to the throttle position) and steered (as to their position each on a vertical axis) by a common additional tiller and control member.

We have now established that the device described in our Great Britain Patent, while useful for its purpose, can be considerably simplified to given an assembly which takes up less space and which is cheaper and simpler to manufacture.

Our present invention is based upon the realisation that it is not strictly necessary to fabricate an additional control means having the appearance and function of a conventional tiller and throttle control. We have now established that the dual function of such a tiller, (that of steering both engines by turning each engine around its vertical axis and that of control of the engine power by a throttle attachments to the carburettors) can be effected in such a way that the two conventional tiller and throttle controls of known engines are interlinked with two joint control devices and still provide an operable joint control devices and still provide an operable total assembly.

In one aspect therefore the invention provides a control gear for use with two or more outboard engines each having a tiller-mounted throttle grip, comprising:

(a) a first tie rod adapted to be connected to both or all of the steering means of the engines to coordinate the steering movements thereof about a vertical axis, in accordance with a steering movement effected by one of the tillers, and (b) a second tie rod adapted to be connected to both or all of the throttle members so that opening or closing movement of the tie rod in its own longitudinal direction, as induced by one throttle actuation, opens or closes all other throttles simultaneously.

The first tie rod can of course be attached to the steering brackets of the respective motors, and the second tie rod can be attached to arms extending outwards from the throttle controls and pivoted at their ends to the tie rods.

If necessary, one or both of the tie rods can be arranged to be readily releasable whereby the steering or throttle controls of the various engines can be separately controlled thereafter. Generally speaking, however, the device itself, which is an installation of tie rods is devoid of control or other facilities, and resides in the linking of existing and conventional controls, albeit by two separate tie rods rather than by previous proposals which have exemplified the use of one interconnection member.

Figure 1:
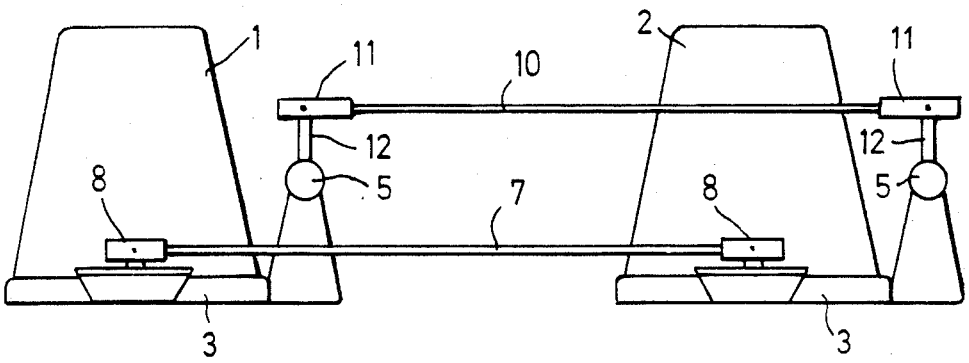
Figure 2:
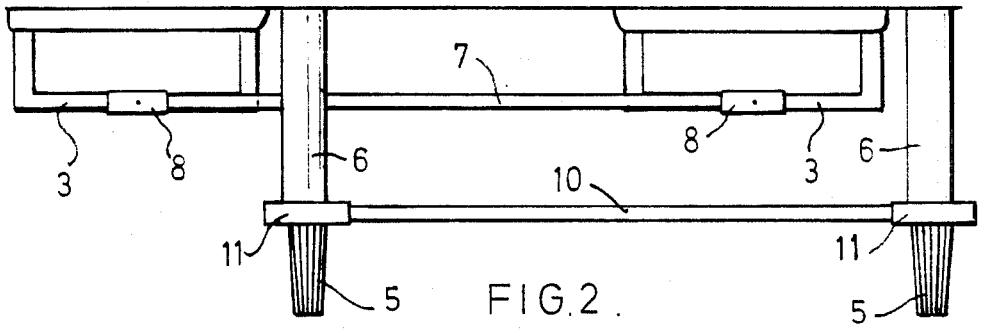
Figure 3:
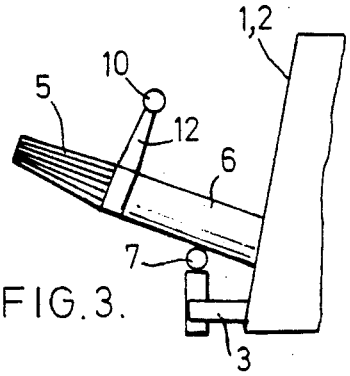

The invention will be further described with reference to the accompanying drawings, in which:

FIG. 1 is a front view of two outboard motors, side-by-side at the stern of a vessel, FIG. 2 is a top view of the said motors at least at their forward parts, and FIG. 3 is a side view of the motors showing various positions of the tie rods.

In FIG. 1 an outboard motor 1 and an outboard motor 2 are in all respects similar and conventional. That is to say, each one has a steering bracket 3, and a flexible control member from a throttle control 5 at the end of a tiller arm 6 (see also FIG. 2) projecting forward from the stern into the vessel. Conventionally, each individual motor can be controlled by someone grasping the respective throttle control 5 at the end of the tiller arm 6 and either twisting it one way or the other to alter the engine power or by pulling the throttle arm to turn the engine about a vertical axis.

In accordance with the invention there is provided a first tie rod 7. This extends between pivot points 8 on the steering bracket 3 for each engine. This tie rod 7 is not attached to the tiller 6, but the effect of the tie rod 7 is that whichever tiller 6 is moved (of either engine) the other will follow by interconnection between steering brackets 3.

There is also provided a tie rod 10 which extends from pivot points 11 on the top of an extension arm 12 attached to the throttle grip 5. If a throttle 5 twisted the steering tie rod 10 is pushed or pulled in the direction of its own length and will open or close the other throttle 5.

I claim:

1. Control gear for a group of at least two like outboard motors mounted side by side, each motor possessing a vertical mounting axis, a forwardly projecting tiller arm by which the motor can be turned about said mounting axis, a throttle, and a throttle grip located on the tiller arm and rotatable to open or close said throttle; said control gear comprising (a) a first tie rod, and at least two pivot means on said first rod pivoted one in relation to each motor at the same position relative to its vertical mounting axis whereby each motor turns about its axis to the same extent when any one tiller arm is moved, and (b) a second tie rod and at least two pivot means on said second rod pivoted one in relation to each throttle grip at the same position relative to said grip whereby each throttle grip rotates to the same extent when any one throttle grip is rotated.

2. Control gear of claim 1 further comprising an arm extending radially outwards from each rotatable throttle grip, each said arm carrying a pivot means for said second tie rod.

3. Control gear of claim 1 further comprising selectively operable release means for at least one of said tie rods.

4. Control gear of claim 2 further comprising selectively operable release means for at least one of said tie rods.

* * * * *